United States Patent [19]

Kikuchi

[11] 4,067,594

[45] Jan. 10, 1978

[54] SKI BOOT TOE BINDING

[75] Inventor: Toshikazu Kikuchi, Nagareyama, Japan

[73] Assignee: Hope Co., Ltd., Tokyo, Japan

[21] Appl. No.: 698,720

[22] Filed: June 21, 1976

[30] Foreign Application Priority Data

Apr. 5, 1976 Japan ..... 51-37120

[51] Int. Cl.[2] ..... A63C 9/085

[52] U.S. Cl. ..... 280/625

[58] Field of Search ..... 280/625

[56] References Cited

U.S. PATENT DOCUMENTS

| | | | |
|---|---|---|---|
| 3,638,959 | 2/1972 | Reuge | 280/625 |
| 3,744,810 | 7/1973 | Jungkind | 280/625 |
| 3,806,143 | 4/1974 | Wyss | 280/625 |

FOREIGN PATENT DOCUMENTS

| | | | |
|---|---|---|---|
| 2,401,152 | 7/1975 | Germany | 280/625 |
| 1,966,462 | 4/1973 | Germany | 280/625 |
| 2,255,604 | 5/1974 | Germany | 280/625 |

*Primary Examiner*—David M. Mitchell

[57] ABSTRACT

Each one of a pair of pivot members is provided at the forward end portion thereof with a boot toe holding member and pivotably connected at the rear end portion thereof to a base plate by a first pin. Each one of a pair of links is pivotably connected at the forward end portion thereof to a pivot member by a second pin, wherein the first pin for the pivot member is located outwardly and rearwardly of the second pin. Each link is urged forwardly by a spring acting on the outer rear end thereof.

4 Claims, 11 Drawing Figures

SKI BOOT TOE BINDING

BACKGROUND OF THE INVENTION

This invention relates to a ski boot toe binding to be attached on a ski.

In one type of known ski boot toe binding, a boot toe holding member is connected to a pivot means which has a roller adapted to be slidably engaged with a cam surface or a guide groove under spring force. In the event that an abnormal external force is applied to the boot toe, the roller slides along the cam surface or the guide groove against the spring force to displace the pivot means, as well as the toe holding member, to a boot toe releasing position.

In such a toe binding, however, a relatively high frictional resistance is produced when the roller slides along the cam surface or the guide groove. Accordingly, the displacement of the pivot means to the toe releasing position from the toe holding position and vice versa is not smooth. In addition, the power of restitution of the pivot means from a displaced position not reaching the toe releasing position to the original toe holding position, is largely decreased due to the frictional resistance and, therefore, it becomes difficult in such a toe binding to have a long critical restitution stroke which allows the pivot member to automatically return to the toe holding position when the force applied to the toe holding member is released.

One of the most important functions of a ski boot toe binding is to absorb an instantaneously applied shock which is not great enough to cause the skier's leg to break and to hold the ski boot to the binding, but which will release the ski boot rapidly when a severe shock is applied to the skier's leg for a relatively long time period. To achieve the above functions satisfactorily, it is said that a boot toe binding having high stock absorbing energy and strong power of restitution is desirable.

The shock absorbing energy of the binding is determined by functions of the critical restitution stroke and the critical releasing force, beyond which force the binding will be displaced to a boot toe releasing position.

Namely, if the critical releasing force of the bindings is made constant, the binding having longer critical restitution stroke has higher shock absorbing energy. On the other hand, if the critical releasing force of the binding is made higher beyond a certain value, the binding will not be released as desired and will cause the skier's leg to break. Therefore, the critical releasing force of the bindings cannot be greater than a certain value in practice, and it is desired to provide a binding having longer critical restitution stroke.

However, if the toe binding having high shock absorbing energy with an elongated critical restitution stroke does not have a strong power of restitution, the binding will not be able to attain the desired function and will be dangerous in skiing because it takes a relatively long time period before the toe holding member, slightly displaced by an unobjectionable shock, returns to the original toe holding position.

Thus, it is desired that toe binding has not only a longer critical restitution stroke, but also strong power of restitution.

In the known toe binding set forth above, the power of restitution is relatively weak and the critical restitution stroke is relatively short, due to the frictional resistance caused by the sliding engagement between the roller and the cam surface or groove, so that the shock absorbing energy of the binding is relatively low.

Apart from the known toe binding set forth above, another type of toe binding is provided as shown in Japanese Pat. No. 50-22457 in which a pair of links are pivotably connected at the forward ends thereof to a toe holding member, and at the rear ends thereof to a base plate and are urged by a spring to usually set the toe holding member to a toe engaging position.

However, in the boot toe binding of this type, since the toe holding member is operably connected to the base plate only by the pair of links, the degree of displacement of the toe holding member is relatively small and therefore, the critical restitution stroke thereof is short with the result that the shock absorbing energy of the binding is relatively low.

SUMMARY OF THE INVENTION

Accordingly, an object of the present invention is to provide a ski boot toe binding having high shock absorbing energy which high power of restitution and long critical restitution stroke.

Another object of the present invention is to provide a ski boot toe binding in which pivot means provided with toe holding members is rotated with minimum frictional resistance.

According to the present ski boot toe binding, each one of a pair of pivot means is provided at the forward end portion thereof with boot toe holding means, and pivotably connected at the rear end portion thereof to a base plate by a first pin.

Each one of a pair of link means is pivotably connected at the forward end portion thereof to the pivot means by a second pin wherein the first pin for the pivot means is located outwardly and rearwardly of the second pin. The link means is urged forwardly by spring means acting on the outer rear ends thereof.

In a preferred embodiment, each one of the pair of link means is pivotally connected at the outer rear end porition thereof to an end of a single lever, and a single compression spring acts on the center portion of the lever to urge the outer rear ends of the link means forwardly through the lever.

The aforementioned and other objects and features of the present invention shall be described hereinafter in detail with reference to preferred embodiments thereof shown in the accompanying drawings, in which:

BRIEF DESCRIPTION OF THE DRAWINGS

FIGS. 1A and 1B through FIGS. 4A and 4B are schematic plan views showing principles of the respective embodiments of the present invention;

DETAILED DESCRIPTION

Figure 1A:
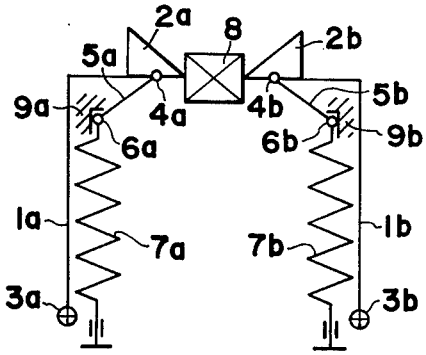

Four embodiments of the present invention are shown in FIGS. 1A — 1B through FIGS. 4A — 4B, in which same reference numerals are applied to designate same parts of these embodiments.

Figure 1B:
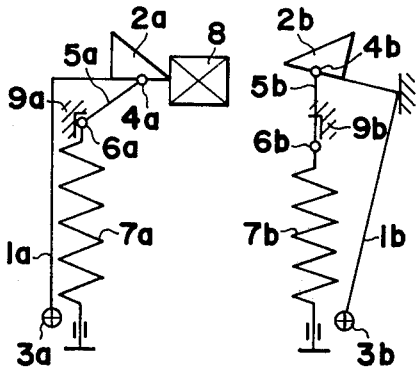

Referring now to the first embodiment of the present boot toe binding shown in FIGS. 1A and 1B, a pair of pivoted body members 1*a* and 1*b* is provided one at each side of a base plate (not shown) to be attached on a ski. Each pivot member has a boot toe holding member 2*a* or 2*b* integral with or connected to the forward end thereof. These pivot members 1*a* and 1*b* are pivotally connected to the base plate at the rear end thereof by pins 3*a* and 3*b*, respectively.

Pivotably connected to the forward end portions of the pivot members 1*a* and 1*b* by pins 4*a* and 4*b* and located inwardly of the pins 3*a* and 3*b*, are the forward ends of links 5*a* and 5*b*, respectively. The links 5*a* and 5*b* have rear end pins 6*a* and 6*b* are located rearwardly and outwardly of the pins 4*a* and 4*b*, *l but forwardly and inwardly of the pins 3a* and 3*b*, respectively. The rear end pins 6*a* and 6*b* of the links are urged forwardly by compression springs 7*a* and 7*b* directly acting on the rear ends thereof, respectively.

Provided between the toe holding members 2*a* and 2*b* is a stop block 8 for setting the pivot members 1*a* and 1*b* and the links 5*a* and 5*b* to the boot toe holding position shown in FIG. 1A. Also, provided adjacent to the rear end pins 6*a* and 6*b* of the links 5*a* and 5*b* are guide means 9*a* and 9*b* respectively, for restricting and preventing any unnecessary rotation of the links in the toe holding position, and for guiding the rear end pins 6*a* and 6*b* of the links rearwardly along the axes of the springs 7*a* and 7*b* when the pivot members 1*a* and 1*b* partially rotate toward the boot toe releasing position.

When an abnormal severe lateral shock is applied to the boot held by the present toe binding in the toe holding position shown in FIG. 1A, one of the pivot members 1*b*, for example, is partially rotated and displaced about the pin 3*b* as the link 5*b* is rotated against the force of compression spring 7*b* and, then, at the position shown in FIG. 1B, the boot is released from the toe holding member 2*b*. At the boot toe releasing position shown in FIG. 1B, in order to prevent the pin 4*b* from rotating outwardly beyond the axial extension of the spring 7*b*, a stop member is provided to prevent the pivot member 1*b* from rotating outwardly any more. Accordingly, after releasing of the boot toe from the binding, the pivot member 1*b* automatically returns to the toe holding position by the action of the spring 7*b* and the link 5*b*.

Although not shown in the drawings, the pivot member 1*a* is also displaced to the toe releasing position by a lateral shock the force of which is opposite to that applied to the pivot member 1*b*.

In the first embodiment shown in FIGS. 1A and 1B, the pivot member 1*a*, link 5*a* and spring 7*a*, which are disposed at one side of the base plate, are not associated with the other pivot member 1*b*, link 5*b* and spring 7*b* disposed at the opposite side of the base plate.

Figure 2A:
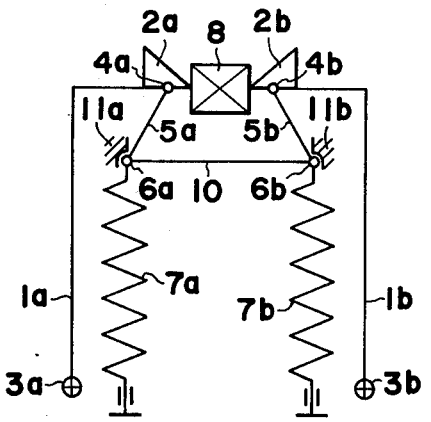
Figure 2B:
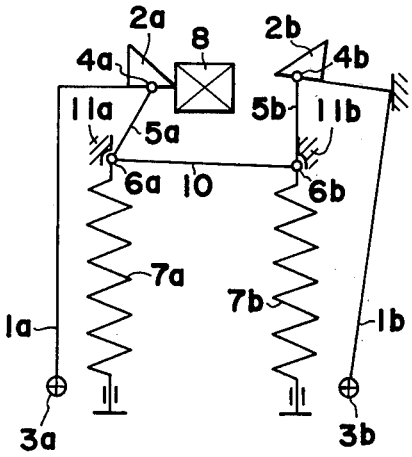

However, in a second embodiment shown in FIGS. 2A and 2B, the rear end pins 6*a* and 6*b* of both links 5*a* and 5*b* are pivotably connected with each other by a connecting lever 10. Accordingly, in the toe binding of the second embodiment, the connecting lever 10 restricts the lateral movement of the rear end pins 6*a* and 6*b* of the levers, so that it becomes unnecessary to provide such means as to guide the retracting movement of the pins 6*a* and 6*b* along the axes of the springs 7*a* and 7*b*, respectively, as in the case of the first embodiment. In place of such guide means, stop members 11*a* and 11*b* are provided in the second embodiment to prevent any unnecessary rotation of the links 5*a* and 5*b* in the toe holding position, and to prevent lateral movement of the connecting lever 10 when the lever 10 inclines by the displacement of the pivot member. Other structures and operations of the toe binding of the second embodiment are substantially the same as those of the first embodiment.

Figure 3A:
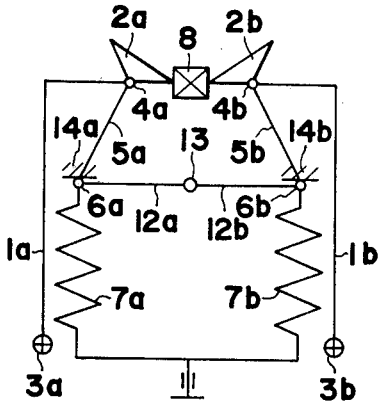
Figure 3B:
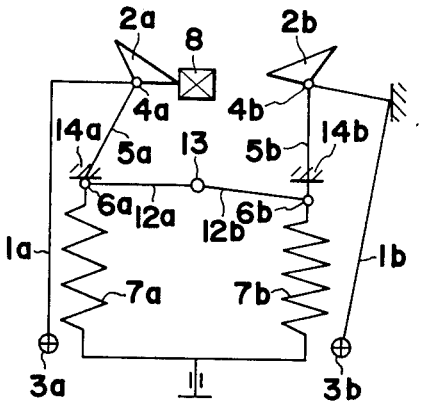

In a third embodiment shown in FIGS. 3A and 3B, the rear end pins 6*a* and 6*b* of the links 5*a* and 5*b* are pivotably connected to outer ends of two connecting levers 12*a* and 12*b*, respectively, which levers are pivoted with each other at the inner ends thereof by means of a pin 13 fixedly provided on the base plate. In this embodiment, the retreat of the pins 6*a* and 6*b* a the rear ends of the links is guided by the connecting levers 12*a* and 12*b*, so that it becomes unnecessary to provide such guide means as mentioned in the first embodiment and, instead, only stop means 14*a* and 14*b* are providing for restricting the undesirable rotation of the links 5*a* and 5*b* in the boot toe holding position. Other structures and functions of this embodiment are substantially the same as those mentioned in the first embodiment of the present invention.

Figure 4A:
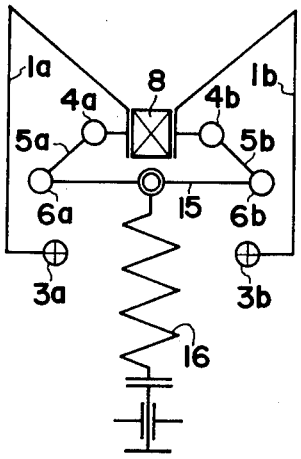
Figure 4B:
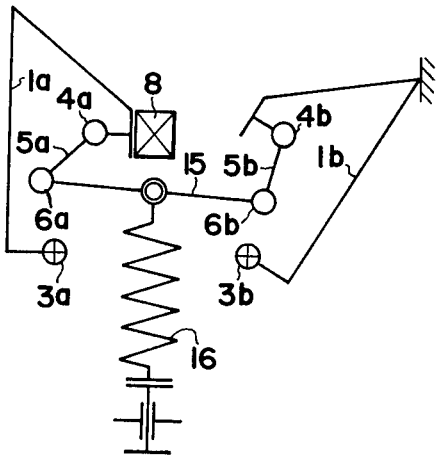

Reference is now made to FIGS. 4A and 4B showing a preferred fourth embodiment of the present invention. In this embodiment, the pins 6*a* and 6*b* at the rear ends of the links 5*a* and 5*b*, respectively, pivotally support both ends of a single connecting lever 15. The connecting lever 15 is urged forwardly by a single compression spring 16 acting on the center part thereof. The pins 6*a* and 6*b* pivotably connecting the lever 15 to the links 5*a* and 5*b* are located slightly outwardly of the pins 3*a* and 3*b* which pivotably support the pivot members 1*a* and 1*b* to the base plate, respectively. Other structures and features of the fourth embodiment are substantially the same as those of the first embodiment.

In such an arrangement of the boot toe binding according to the fourth embodiment, when an abnormal severe lateral shock is applied through the boot to one of the pivot members 1*b* in the toe holding position, the pivot member 1*b* starts rotating about the pin 3*b*, thereby compressing the spring 16 through the link 5*b* and connecting lever 15. The rotation of the pivot member 1*b* about the pin 3*b* is restricted by a stop member just before the pins 4*b* 6*d* become aligned with the pin 3*b*, where the boot toe is released from the toe holding member of the pivot member 1*b*. After releasing of the toe of the ski boot, the compression force of the spring 16 is effectively transmitted to the pivot member 1*b* through the connecting lever 15 and the link 5*b* and allows the pivot member 1*b* to be rapidly returned to the toe holding position. Though it is not shown in the drawings, the other pivot member 1*a* is rotated or displaced to the toe releasing position like the pivot member 1*b* when an abnormal severe lateral shock is applied to the boot in the opposite direction.

Figure 5:
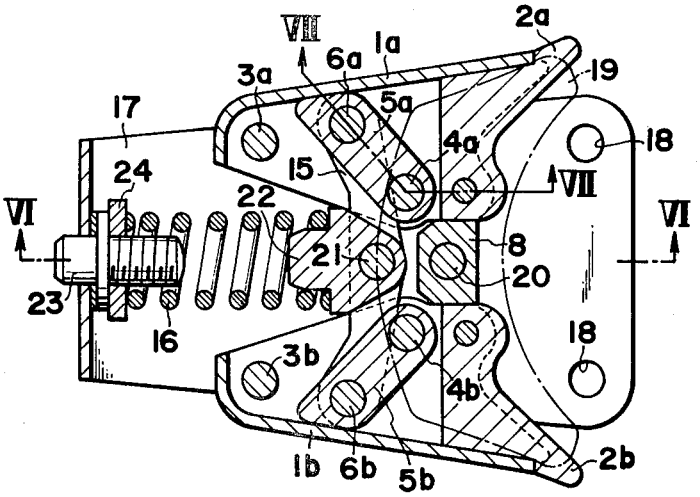
FIG. 5 is a plan view of the present boot toe binding according to a fourth embodiment.
Figure 6:
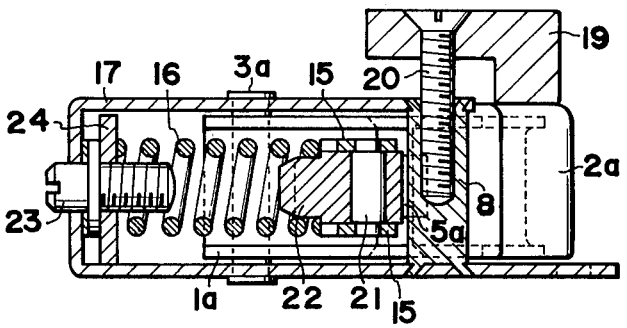
FIG. 6 is a sectional view taken along line VI—VI in FIG. 5.
Figure 7:
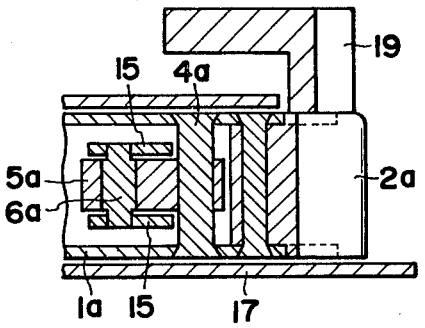
FIG. 7 is a sectional view taken along line VII—VII in FIG. 5.

FIGS. 5 through 7 show a practical boot toe binding in which the principle of the fourth embodiment according to the present invention is employed. As shown in these Figures, a base body 17 is formed of a hollow housing with the forward end and side being open and adapted to be attached on a ski by screws passing through holes 18 at the forward end of the bottom plate of the housing. A pair of pivot members 1*a* and 1*b* of hollow structure is disposed one on each side of the base body 17, and partially extending into the hollow space of the body 17. The pivot members 1*a* and 1*b* are pivotably connected at the rear ends thereof to the base body 17 by pins 3*a* and 3*b*, respectively. Integrally formed with or connected to the forward end of the pivot members 1*a* and 1*b* are toe holding members 2*a* and 2*b*, respectively, between which a stop block 8 is disposed. The stop block 8 is fixed to the top and bottom plate sections of the base body 17. A jaw member 19, for restricting the boot toe from being released upwardly, is connected to the stop block 8 by a screw 20.

Disposed within the hollow space of each of the pivot members 1*a* and 1*b* is a link 5*a* and 5*b*. The links 5*a* and 5*b* are pivotably connected at the forward ends thereof to the pivot members by pins 4*a* and 4*b*, which are located, respectively, forwardly and inwardly of the pins 3*a* and 3*b* of the pivot members. These links are also pivotably connected at the rear ends thereof to both ends of a connecting lever 15, made of a pair of upper and lower plates, by means of pins 6*a* and 6*b*, which are located respectively, rearwardly and outwardly of the pins 4*a* and 4*b*, but forwardly and outwardly of the pins 3*a* and 3*b*. As it is shown in FIG. 5, the rear end portions of the links 5*a* and 5*b* contact the inner surface of the pivot members 1*a* and 1*b*, respectively, whereby both links 5*a* and 5*b* assume the position as shown when the binding holds the boot toe.

The connecting lever 15 has a spring receiving member 22 which is pivotably mounted at the center part thereof by a pin 21. A compression spring 16 is interposed between the spring receiving member 22 and a plate 24 threadedly engaged with an adjusting screw 23 which partially extends into the hollow space of the base body 17 through the rear end wall thereof.

The operations of the toe binding shown in FIGS. 5 through 7 are substantially the same as those mentioned with reference to the fourth embodiment shown in FIGS. 4A and 4B.

As it is disclosed in the embodiments set forth above, in the present toe binging the compression force of the springs 7*a* and 7*b*, or 16 is transmitted to the pivot members 1*a* and 1*b* through the links 5*a* and 5*b*, so that the frictional resistance, which is produced when the pivot member is rotated or displaced from the toe holding position to the toe releasing position, is produced only at the pivot portions of the links and the pivot members and, therefore, it is very small. Accordingly, compared with the known toe binding in which a roller slides along the cam surface or a guide groove, the spring force is effectively transmitted to the pivot member in the present toe binding. This means that, in the present to binding, not only does the displacement of the pivot members become more smooth, but also the power of restitution of the binding can be higher with less frictional resistance. The higher power of restitution of the binding makes it possible to have longer critical restitution stroke.

In addition, in the present toe binding, with such arrangements wherein each pivot member pivoted to the base plate or body by the first pin 3*a* or 3*b* is also pivoted to the forward end of the link by the second pin 4*a* or 4*b*, which is located forwardly and inwardly of the first pin, and wherein the rear end 6*a* or 6*b* of the link is located rearwardly and outwardly of the second pin and urged forwardly by the spring, the degree of displacement of the pivot member can be larger compared with that of the link. Accordingly, the present binding can have a longer critical restitution stroke. Such elongated critical restitution stoke and higher power of restitution of the present binding will provide a toe binding having higher shock absorbing energy.

Further, in the embodiment of the present invention in which a pair of links pivoted at the inner ends thereof to the pivot members, are also pivotably connected at the rear ends thereof to both ends of the connecting levers, when the pivot member is displaced by means of the link, the rear end of the link is guided to retract along the axis of the spring acting thereon, with the result that spring force is proportionally increased against the lateral shock applied to the pivot member.

Moreover, in the fourth embodiment of the present invention in which a pair of links are pivotably connected at the rear ends thereof to both ends of a single lever, and a single compression spring acts on the center portion of the lever to urge the links forwardly, the spring force is evenly and uniformly applied to both of the toe holding members. Thus, it can eliminate uneveness of the binding force of both of the toe holding members, which uneveness is often caused when two or more springs are used due to uneven compression forces of these springs.

Although the present invention has been described with reference to the referred embodiments of the present invention, many modifications and alterations may be made within the spirit of the present invention.

I claim:

1. A ski boot toe binding comprising a base plate adapted to be attached on a ski, said plate having a forward end portion and a rear end portion, a pair of pivoted member each having a forward and rear end portion and pivotally connected at the rear end portion thereof to said plate by a first pivot pin, boot toe holding means on each of said pivoted members at the forward end thereof, a pair of links, one for each pivoted member, each link having an inner end pivotally connected to its associated pivoted member by a second pivot in and an outer end extending angularly outwardly and rearwardly from said inner end thereof to hold the associated pivoted member inwardly against the boot in a toe-holding position, lever means extending transversely of said plate and terminating in outer end portions pivotally connected to the said outer ends of said links by a third pivot pin to permit outward movement of said pivoted members and toe holding members away from the boot when a lateral shock is applied to the boot, the said first pivot pin being located rearwardly and outwardly of said second pivot pin, and yieldable means urging the said outer ends of said links toward the forward end portion of said plate.

2. A ski boot toe binding as claimed in claim 1, wherein said lever means is a single lever pivotably connected to said links at both end portions thereof by said third pins, and said yieldable means is a single spring acting on the center portion of said lever intermediate the said outer ends thereof to urge said third pins toward the forward end of said plate through said lever.

3. A ski boot toe binding as claimed in claim 1, wherein said lever means comprises two levers having inner ends located inwardly of the said outer ends thereof and pivotally connected with each other at said inner ends thereof to a pin fixedly mounted on said base plate, and also pivotally connected at the outer ends thereof to said links by said third pins, and said yieldable means comprises two springs each directly acting on said third pin.

4. A ski boot toe binding as claimed in claim 1, wherein said lever means is a single lever pivotably connected to said links at both end portions thereof by said third pins, and said spring means comprises two compression springs each directly acting on one of said third pins.

* * * * *

UNITED STATES PATENT OFFICE

CERTIFICATE OF CORRECTION

Patent No. 4,067,594 Dated January 10, 1978

Inventor(s) Toshikazu Kikuchi

It is certified that error appears in the above-identified patent and that said Letters Patent are hereby corrected as shown below:

Col. 3, line 10, after "6b" insert --which--;

Col. 4, line 40, after "4b" insert --and--; and

Col. 4, line 40, "6d" should be --6b--.

Signed and Sealed this

Eighteenth Day of April 1978

[SEAL]

Attest:

RUTH C. MASON
Attesting Officer

LUTRELLE F. PARKER
Acting Commissioner of Patents and Trademarks